US009995516B2

(12) United States Patent
Lifson et al.

(10) Patent No.: US 9,995,516 B2
(45) Date of Patent: Jun. 12, 2018

(54) SUPERHEAT CONTROL FOR HVACANDR SYSTEMS

(75) Inventors: Alexander Lifson, Manlius, NY (US); Michael F. Taras, Fayetteville, NY (US); Richard Lord, Murfressboro, TN (US)

(73) Assignee: Carrier Corporation, Farmington, CT (US)

( * ) Notice: Subject to any disclaimer, the term of this patent is extended or adjusted under 35 U.S.C. 154(b) by 1647 days.

(21) Appl. No.: 12/161,700

(22) PCT Filed: May 26, 2006

(86) PCT No.: PCT/US2006/020509

§ 371 (c)(1),
(2), (4) Date: Mar. 11, 2011

(87) PCT Pub. No.: WO2007/139537

PCT Pub. Date: Dec. 6, 2007

(65) Prior Publication Data

US 2011/0185753 A1 Aug. 4, 2011

(51) Int. Cl.
*F25B 1/00* (2006.01)
*F25B 31/00* (2006.01)
(Continued)

(52) U.S. Cl.
CPC ..... *F25B 49/02* (2013.01); *F25B 31/006* (2013.01); *F25B 41/043* (2013.01);
(Continued)

(58) Field of Classification Search
USPC ..... 62/222, 224, 225, 226, 227, 228.1, 498, 62/505
See application file for complete search history.

(56) References Cited

U.S. PATENT DOCUMENTS 2,120,764 A * 6/1938 Newton ..... 62/83
4,244,182 A 1/1981 Behr
(Continued)

FOREIGN PATENT DOCUMENTS

DE 4212162 A1 10/1993
DE 9416795 U1 1/1995
(Continued)

OTHER PUBLICATIONS

Search Report and Written Opinion PCT/US06/20509.
EP Search Report from counterpart EP 06 77 1336.

*Primary Examiner* — Melvin Jones
(74) *Attorney, Agent, or Firm* — Carlson, Gaskey & Olds, PC

(57) ABSTRACT

A superheat control utilizes a sensor at a location downstream of an evaporator after some heat is delivered to the refrigerant. In one embodiment, the compressor is a sealed compressor with at least a portion of the refrigerant being heated by an electric motor. The temperature is sensed after the refrigerant temperature has increased after passing over the electric motor. In another embodiment, the refrigerant temperature is measured after some minimal compression and minimal temperature rise has occurred within the compressor pumping elements. In either case, by measuring the temperature of the refrigerant after some additional heat has been added to the refrigerant, the refrigerant super-heat leaving the evaporator can be controlled to a lower value. The improved superheat control enhances the system performance by increasing system efficiency, system capacity and improving oil return to the compressor.

49 Claims, 1 Drawing Sheet

(51) Int. Cl.
*F25B 49/02* (2006.01)
*F25B 41/04* (2006.01)

(52) U.S. Cl.
CPC ... *F25B 2600/21* (2013.01); *F25B 2600/2513* (2013.01); *F25B 2700/2115* (2013.01); *F25B 2700/21151* (2013.01); *F25B 2700/21175* (2013.01)

(56) References Cited

U.S. PATENT DOCUMENTS

| | | | |
|---|---|---|---|
| 4,878,355 | A | 11/1989 | Beckey |
| 5,076,067 | A | 12/1991 | Prenger |
| 5,475,985 | A | 12/1995 | Heinrichs |
| 5,477,701 | A | 12/1995 | Kenyon et al. |
| 6,341,496 | B1 | 1/2002 | Kettner et al. |
| 6,615,598 | B1 | 9/2003 | Wang |

FOREIGN PATENT DOCUMENTS

| | | | |
|---|---|---|---|
| DE | 19908043 | A1 | 9/2000 |
| WO | 03106900 | A1 | 12/2003 |

* cited by examiner

SUPERHEAT CONTROL FOR HVACANDR SYSTEMS

BACKGROUND OF THE INVENTION

This application relates to a refrigerant superheat control to enhance system performance and improve compressor reliability.

In air conditioning, heat pump and refrigeration systems, a superheat of the refrigerant leaving an evaporator needs to be closely controlled. Refrigerant leaves the evaporator normally at the superheated state, where its actual temperature is higher than the corresponding saturation temperature (a superheat is actually defined as the difference between these two temperatures). A certain (positive) superheat is typically required to ensure that little or no liquid refrigerant enters the compressor and system operation is stable. If a significant amount of liquid refrigerant enters the compressor, an undesirable condition known as "flooding" will occur.

On the other hand, it is known that in order to assure the highest performance (efficiency and capacity) of the refrigerant system, close to zero superheat values for the refrigerant leaving the evaporator are to be maintained. Further, by reducing suction superheat, the oil return to the compressor is also improved, as the oil viscosity is reduced with the reduced superheat. This is true, since more refrigerant is diluted in the oil at lower superheat values. Conversely, as the superheat value is increased, refrigerant is boiled off from the oil increasing the oil viscosity and making the oil more prone to stagnate at the evaporator exit or in the piping connecting the evaporator to the compressor. Of course, improving oil return is a goal of a refrigerant system designer, as it enhances compressor reliability and enhances system performance by preventing oil retention in the evaporator and associated piping.

While it is known to be desirable to reduce the superheat to the lowest value possible, to date most refrigerant system, at best, would operate with superheat values in a range of 6-12° F. The potential for a measurement error due to temperature sensor measurement tolerances, calibration and resolution; system component manufacturing variability; ambient effects on system operation; load demand fluctuations and associated transient phenomena, concurrently occurring within the refrigerant system, have typically provided a practical bar to further reduction in the superheat setting.

As also known, typically, a temperature (and the associated superheat value) of the refrigerant downstream of the evaporator is utilized for the system operational control either to provide safe and reliable compressor operation, or to prevent an expansion device, such as a thermostatic expansion valve, malfunctioning, or both.

It is undesirable, as mentioned above, to have significant flooding in the compressor, due to associated reliability issues. Thus, the refrigerant system designers have erred on the side of applying sufficient superheat to eliminate any potential for such flooding at an entire spectrum of operating conditions. Uncontrolled flooding results in a drastic drop in compressor capacity and efficiency, and may also cause severe damage to the compressor.

The present invention allows operation at a much lower superheat setting, and perhaps even with slight flooding at the compressor entrance (or evaporator exit), without any detrimental effects on compressor reliability and at higher system efficiency and capacity. At the same time, the present invention ensures that no significant amount of liquid refrigerant will enter the compressor pumping elements.

SUMMARY OF THE INVENTION

In one disclosed embodiment of this invention, the refrigerant temperature is measured inside the compressor. Preferably, the temperature is measured after refrigerant has undergone some preheating before it enters the compression elements. Such preheating, for example, could be associated with the motor heat dissipated into the refrigerant, or with heating by the ambient environment while the refrigerant is transferred from the evaporator to the compressor. Thus, the superheat values of the refrigerant leaving the evaporator could be reduced to the desired, close to zero values. On the other hand, while limited amount of liquid can enter the compressor shell, the additional heat delivered prior to the initiation of the compression process will assure that no liquid refrigerant will be entering the compression elements inside the compressor shell. Thus, compressor reliability will not be compromised. The superheat value, for example, can be calculated by subtracting the actual refrigerant temperature form its saturation temperature. The refrigerant temperature is normally determined by a temperature sensor located inside the refrigerant system or a temperature sensor attached to the "airside" of the piping, compressor shell, etc. to deduce the refrigerant temperature based on the temperature of the metal components surrounding and in direct contact with the refrigerant. For instance, the sensor on the inside or outside of the compressor shell can be installed at the factory or added to the compressor in the field. The refrigerant saturation temperature can be established by means of various sensors, including a temperature sensor located in the two-phase region of the refrigerant system heat exchangers (either inside or outside) or pressure sensor measuring the refrigerant pressure. As known in the art, the saturation temperature can be deduced from the refrigerant pressure measurements.

As an example, and in one disclosed embodiment, it is known to deliver suction refrigerant to a hermetic or semi-hermetic compressor into a sealed housing shell containing both the compressor pump unit (compression elements) and electric motor. In one known application of such compressors, at least a portion of the refrigerant is allowed to initially flow over the motor, cooling the motor. When the refrigerant cools the motor, heat is delivered into the refrigerant. In the disclosed embodiment, the refrigerant temperature to control an expansion device is determined at the location where the refrigerant has already picked up some heat after it has cooled the motor and as the refrigerant approaches the compressor pump unit. Taking this refrigerant temperature at this location within the compressor shell minimizes the evaporator superheat and, at the same time, allows for evaporator performance enhancement and reliable compressor operation.

In another embodiment, if a motor is located outside of the compressor shell, then the refrigerant temperature can be measured at an early stage of compression within the compressor pump unit. In this manner, the heat delivered by internal compression within the compression elements to the refrigerant. This additional heat will quickly boil off any limited, controlled amount of liquid entering the compression elements. Again, this will allow a reduction in the amount of superheat that is deemed necessary to eliminate the potential for substantial amount of flooding at the compression elements as well as assure stable system operation.

In some applications, thus it may be possible and beneficial to have a slight flooding at the evaporator exit with a two-phase refrigerant leaving the evaporator.

In the present invention, a scroll compressor and a screw compressor are used as illustrations, though other type of compressors would naturally fall within the scope of this invention, such as reciprocating compressors, rotary compressors, centrifugal compressors, etc.

Further, the present invention is especially useful when utilized in a refrigerant system incorporating an electronic expansion device with the temperatures measured directly and then transmitted via a controller through a feedback mechanism to the electronic expansion device. Additionally, with such an electronic expansion valve, various values of superheat can be preset and dialed in, if necessary. The invention would also apply to an expansion device utilizing a thermal expansion bulb as a sensing element, which communicates the sensed temperature back and controls the expansion device by mechanical means. Such a device would preferably be utilized with the bulb located external to the compressor housing shell, and, for example can be inserted into a thermowell, with the thermowell being, for example, located in the vicinity of the compressor pump set entrance or slightly into the compression process. The thermowell normally is the integral part of the compressor housing. The measurements of the oil temperature in the compressor oil sump, either form inside or outside of the shell, can also be used to deduce the amount of superheat at the evaporator exit.

These and other features of the present invention can be best understood from the following specification and drawings, the following of which is a brief description.

DETAILED DESCRIPTION OF THE PREFERRED EMBODIMENTS

Figure 1:
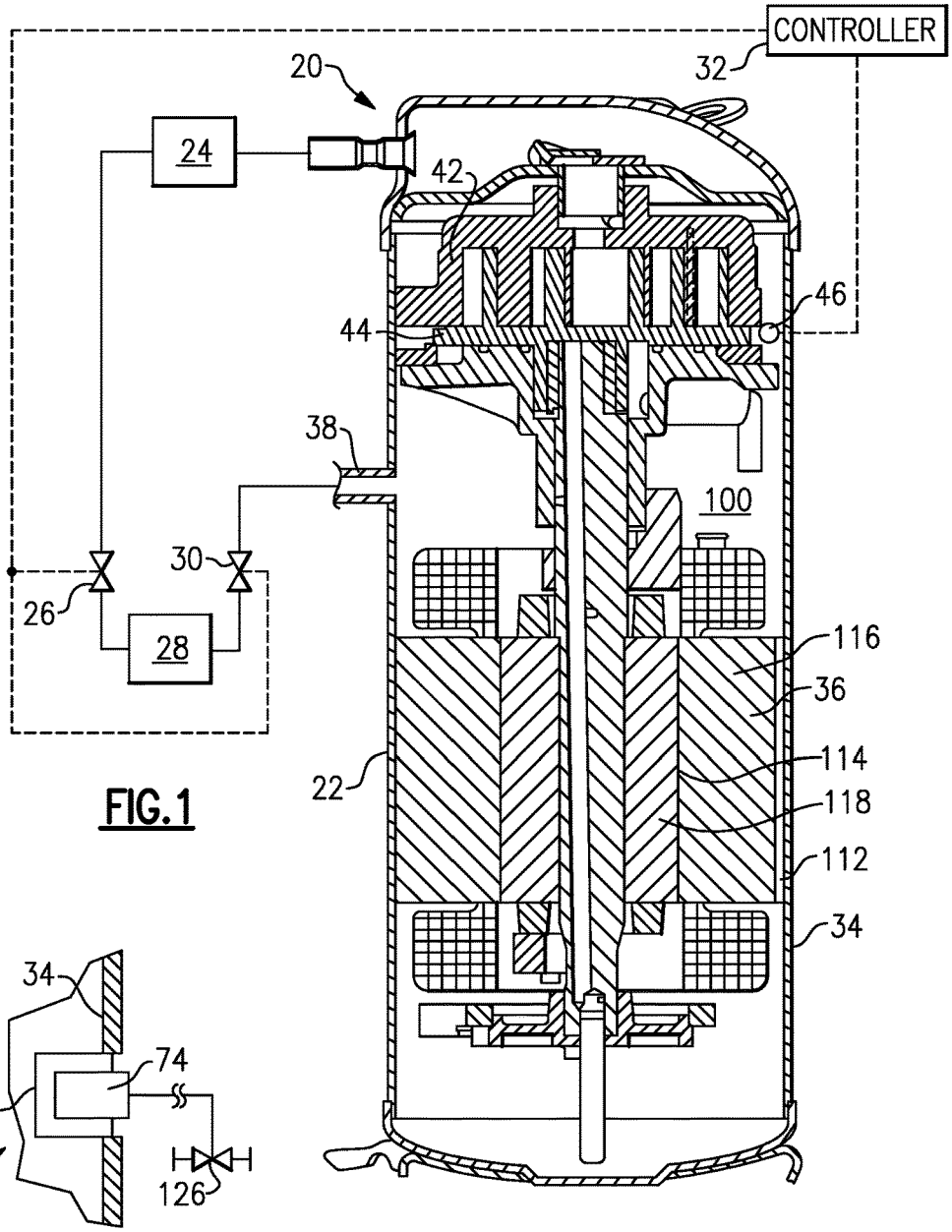
FIG. 1 is a cross-sectional view of a refrigerant system incorporating the present invention.

A refrigerant system 20 is illustrated in FIG. 1 incorporating, as an example, a scroll compressor 22 delivering compressed refrigerant downstream to a condenser 24. An expansion device 26 is preferably an electronic expansion device, and is generally known in the industry. Refrigerant having passed through the expansion device 26 passes through an evaporator 28 through an optional suction modulation valve 30, and through a suction line 38 back to the compressor 22. A compressor shell 34 houses an electric motor 36, and a compressor pump unit incorporating a non-orbiting scroll member 42 and an orbiting scroll member 44. As is shown in this Figure, a temperature sensor 46 is placed within the housing shell 34 and adjacent to a suction entrance for the compressor pump unit. The sensor 46 communicates with an electronic controller 32, which in turn controls the electronic expansion device 26, or/and the optional suction modulation valve 30.

It is known in the art to utilize a temperature sensed at the evaporator 28 exit location or on the compressor suction line 38, before refrigerant enters the compressor 22, and communicate the value of this temperature to an electronic controller, with the electronic controller than controlling the electronic expansion device 26, or/and the suction modulation valve 30. By measuring a temperature inside the compressor shell 34, the present invention takes advantage of the fact that the refrigerant having passed over the motor 36 cools the motor, causing the refrigerant temperature to increase. As seen in the FIG. 1, after the refrigerant enters the compressor, some portion of the refrigerant is delivered directly to the scroll elements 42 and 46 and the other part of the refrigerant finds its way to the bottom of the motor through the gaps 112 between the compressor shell 34 and the motor stator 116 as well as the gap 114 between the motor rotor 118 and the stator 116. The refrigerant then finds its way back from the bottom of the shell through these and other gaps back into the compression elements 42 and 46, cooling the motor. Thus, additional motor heat has been consumed by the refrigerant. As in case of the prior art, if the temperature sensor would had been located on the suction line outwardly of the housing shell 34, the temperature of the refrigerant that is utilized to determine the refrigerant superheat would not take into account this additional heat added to the refrigerant prior to the refrigerant entering the compression elements. By utilizing this downstream location for the temperature sensor 46, the present invention allows a compressor designer to better match the provided superheat with that minimum superheat which is desired. The present invention thus allows the compressor designer to lower the superheat value of the refrigerant leaving the evaporator to the values far below the commonly used 6-12° range of the prior art and enhance system performance while assure reliable compressor operation. Additionally, the compressor discharge and oil temperatures are reduced, further improving compressor reliability.

Figure 2:
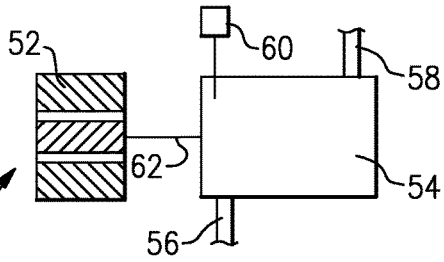
FIG. 2 is a schematic view of a second embodiment.

FIG. 2 shows another embodiment 50, wherein an electric motor 52 is located outside of the compressor 54 and has a drive transmission 62. A suction line 56 and a discharge line 58 communicate the compressor with other components of a refrigerant system, such as shown in FIG. 1. In this case, the temperature sensor 60 is located preferably within the compressor pump unit 54 at a location before a substantial compression has occurred. At this location, the refrigerant will be heated additionally by the compression process provided by the elements of the compressor pump unit 54. Thus, by taking the temperature at this location, the control is better equipped to minimize the amount of superheat deemed necessary at the evaporator 28. This embodiment is particularly well suited for screw or centrifugal compressors. The compressor pump unit 54 is disclosed as a screw compressor. As in the previous embodiment, a small amount of liquid in a two-phase refrigerant would be allowed at the evaporator exit.

Figure 3:
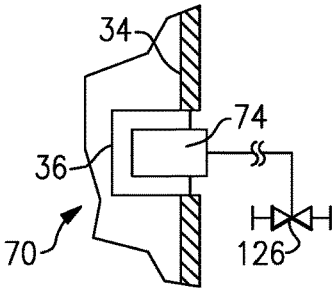
FIG. 3 is a partial view of another embodiment.

FIG. 3 shows another embodiment 70, wherein the compressor shell 34 includes a thermowell 36 preferably positioned at the same location of the FIG. 1 sensor 46. This invention is particularly useful for a thermal expansion device 126 having a bulb 74 as a sensing element that contains a substance, which expands and contracts in response to the sensed temperature. The bulb can be made to be a part of the thermowell installation. Again, this type of control is known in the art. It is the location of the bulb that is inventive here.

A worker of ordinary skill in the art would recognize how to use the sensed refrigerant temperature to control the expansion devices 26 and 126 or/and the suction modulation valve 30 to achieve a desired superheat. This control forms no portion of this invention. Rather, it is the use of such control to obtain more optimal superheat values that provide enhanced system performance and reliable compressor operation that is inventive here. If the electronic expansion is replaced by the TXV (thermal expansion device) then the use of a controller may not be needed at all, as the amount of superheat can be directly (mechanically) controlled by the TXV type expansion device itself. In summary, the refrigerant temperature is measured either inside of the compressor or on the compressor shell to control the thermodynamic state of refrigerant (the amount of superheat or amount of liquid) at various possible locations between the evaporator and compressor pumping elements.

Although the present invention is predominantly illustrated for a scroll compressor, other type of compressors would naturally fall within the scope of this invention such as screw compressors, reciprocating compressors, rotary compressors, centrifugal compressors, etc. An example of refrigerant systems that fall with the scope of this invention include air conditioning systems and heat pump systems for cooling or/and respectively heating houses, building, computer rooms, etc. The refrigerant systems also include refrigeration systems to cool and freeze products in refrigeration containers, truck-trailer units, and supermarket installations. As known, the refrigerant systems can be equipped with multiple circuits, have various means of compressor unloading, as well as being equipped with various performance enhancement options and features such as for instance an economizer cycle. A variety of different type of refrigerants can be used in these systems including, but not limited to, R410A, R134a, R404A, R22, and $CO_2$.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A refrigerant system comprising:

a compressor, said compressor having a compressor pump unit and a suction inlet;

a compressed refrigerant passing from said compressor downstream to a condenser and then downstream to an expansion device;

an evaporator positioned downstream of said expansion device;

a sensor for sensing a temperature of a refrigerant after heat has been added to the refrigerant downstream of the evaporator and said sensor being utilized to maintain a refrigerant thermodynamic state at a location between the expansion device and within compression elements; and a parameter at least partially defining said refrigerant thermodynamic state is selected from the following set: refrigerant temperature, refrigerant superheat, quality of the refrigerant.

2. A refrigerant system comprising:

a compressor, said compressor having a compressor pump unit and a suction inlet;

a compressed refrigerant passing from said compressor downstream to a condenser and then downstream to an expansion device;

an evaporator positioned downstream of said expansion device;

a sensor for sensing a temperature of a refrigerant after heat has been added to the refrigerant downstream of the evaporator and said sensor being utilized to maintain a refrigerant thermodynamic state at a location between the expansion device and within compression elements; and wherein said location is selected from the following set of possible locations: a) between an evaporator exit and a compressor inlet, b) near an evaporator exit, c) between the compressor inlet and an entrance to the compressor pump unit, d) within the compressor pump unit, e) within the vicinity of the compressor pump unit.

3. The refrigerant system as set forth in claim 1, wherein said compressor pump unit is driven by an electric motor.

4. The refrigerant system as set forth in claim 3, wherein said location is between the motor and the compressor pump unit.

5. The refrigerant system as set forth in claim 1, wherein said compressor is a sealed compressor and said sealed compressor having a housing with an electric motor and the compressor pump unit, and said sensor is located such that at least a portion of the refrigerant reaching said sensor has cooled the electric motor.

6. The refrigerant system as set forth in claim 1, wherein said sensor measures temperature within the compressor.

7. The refrigerant system as set forth in claim 6, wherein said sensor measures temperature within the compressor pump unit.

8. The refrigerant system as set forth in claim 6, wherein said sensor measures temperature outside of the pump unit.

9. The refrigerant system as set forth in claim 1, wherein said sensor is positioned outside of the compressor and measures temperature of a compressor shell.

10. The refrigerant system as set forth in claim 2, wherein a parameter at least partially defining said refrigerant thermodynamic state is selected from the following set: refrigerant temperature, refrigerant superheat, quality of the refrigerant.

11. The refrigerant system as set forth in claim 1, wherein said heat is added by at least one of the following: heat generated by an electric motor, heat generated by friction, heat generated by a compression process within the compressor pump unit, and heat from an ambient environment.

12. The refrigerant system as set forth in claim 1, wherein said compressor has a housing containing said compressor pump unit and an electric motor is located outside of said housing.

13. The refrigerant system as set forth in claim 1, wherein said sensor communicates with an electronic control, said electronic control controlling the refrigerant system to achieve a desired amount of superheat.

14. The refrigerant system as set forth in claim 13, wherein said electronic control controls the expansion device.

15. The refrigerant system as set forth in claim 1, wherein said sensor is a temperature sensor.

16. The refrigerant system as set forth in claim 15, wherein said sensor is a temperature transducer.

17. The refrigerant system as set forth in claim 15, wherein a thermowell is formed within a housing of the compressor.

18. The refrigerant system as set forth in claim 17, wherein a temperature sensor is located within said thermowell.

19. The refrigerant system as set forth in claim 18, wherein said sensor measures temperature at the location that is selected from the following set of possible locations: a) within the compressor pump unit, b) within the compressor, c) within the compressor oil sump, d) within the vicinity of the compressor pump unit.

20. The refrigerant system as set forth in claim 1, wherein said sensor is a bulb of a thermal expansion device.

21. The refrigerant system as set forth in claim 1, wherein a bulb communicates with said expansion device to control the refrigerant thermodynamic state.

22. The refrigerant system as set forth in claim 1, wherein said compressor pump unit is a scroll compressor, said scroll compressor having a non-orbiting scroll member having a base and a generally spiral wrap, and an orbiting scroll member having a base and a generally spiral wrap, and a suction port leading into compression chambers defined between said wraps of said orbiting and non-orbiting scroll members, said temperature sensor being adjacent to said suction port.

23. The refrigerant system as set forth in claim 1, wherein a compressor is selected from a group of a screw compressor, a rotary compressor, a centrifugal compressor and a reciprocating compressor.

24. The refrigerant system as set forth in claim 1, wherein the expansion device is a thermal expansion device.

25. The refrigerant system as set forth in claim 1, wherein the expansion device is an electronic expansion device.

26. A method of operating a refrigerant system comprising:

providing a compressor, said compressor having a compressor pump unit and a suction inlet;

a compressed refrigerant passing from said compressor downstream to a condenser and then downstream to an expansion device;

an evaporator positioned downstream of said expansion device;

a sensor for sensing a temperature of a refrigerant after heat has been added to the refrigerant downstream of the evaporator, said sensor sending a signal to control a refrigerant thermodynamic state at a location between the expansion device and within compression elements; and wherein said refrigerant thermodynamic state is at least partially defined by a parameter selected from the following set: refrigerant temperature, refrigerant superheat, quality of the refrigerant.

27. The method as set forth in claim 26, wherein said location is selected from the following set of possible locations: a) between the evaporator exit and the compressor inlet, b) near the evaporator exit, c) between the compressor inlet and the entrance to the compressor pump unit, d) within the compressor pump unit, e) within the vicinity of the compressor pump unit.

28. The method as set forth in claim 26, wherein said compressor pump unit is driven by an electric motor.

29. The method as set forth in claim 28, wherein said location is between the motor and the compressor pump unit.

30. The method as set forth in claim 26, wherein said compressor is a sealed compressor and said sealed compressor having a housing with an electric motor and the compressor pump unit, and said sensor is located such that at least a portion of the refrigerant reaching said sensor has cooled the electric motor.

31. The method as set forth in claim 26, wherein said sensor measures temperature within the compressor.

32. The method as set forth in claim 31, wherein said sensor measures temperature within the pump unit.

33. The method as set forth in claim 31, wherein said sensor measures temperature outside of the pump unit.

34. The method as set forth in claim 26, wherein said sensor is positioned outside of the compressor and measures temperature of a compressor shell.

35. The method as set forth in claim 26, wherein said heat is added by at least one of the following: heat generated by an electric motor, heat generated by friction, heat generated by a compression process within the compressor pump unit, and heat from an ambient environment.

36. The method as set forth in claim 26, wherein said compressor has a housing containing said compressor pump unit and an electric motor is located outside of said housing.

37. The method as set forth in claim 26, wherein said sensor communicates with an electronic control, said electronic control controlling the refrigerant system to achieve a desired amount of superheat.

38. The method as set forth in claim 37, wherein said electronic control controls an expansion device.

39. The method as set forth in claim 26, wherein said sensor is a temperature sensor.

40. The method as set forth in claim 39, wherein said sensor is a temperature transducer.

41. The method as set forth in claim 39, wherein a thermowell is formed within a housing for the compressor.

42. The method as set forth in claim 41, wherein a temperature sensor is located within said thermowell.

43. The method as set forth in claim 42, wherein said sensor is formed to measure temperature at the location that is selected from the following set of possible locations: a) within the compressor pump unit, b) within the compressor, c) within the compressor oil sump, d) within the vicinity of the pump unit.

44. The method as set forth in claim 26, wherein said sensor is a bulb of a thermal expansion device.

45. The method as set forth in claim 26, wherein a bulb communicates with said expansion device to control the refrigerant thermodynamic state.

46. The method as set forth in claim 26, wherein said compressor pump unit is a scroll compressor, said scroll compressor having a non-orbiting scroll member having a base and a generally spiral wrap, and an orbiting scroll member having a base and a generally spiral wrap, and a suction port leading into compression chambers defined between said wraps of said orbiting and non-orbiting scroll members, said temperature sensor being adjacent to said suction port.

47. The method as set forth in claim 26, wherein a compressor is selected from a group of a screw compressor, a rotary compressor, a centrifugal compressor and a reciprocating compressor.

48. The method as set forth in claim 26, wherein the expansion device is a thermal expansion device.

49. The method as set forth in claim 26, wherein the expansion device is an electronic expansion device.

* * * * *